US005811157A

United States Patent [19]

Kurtz et al.

[11] Patent Number: 5,811,157

[45] Date of Patent: Sep. 22, 1998

[54] METHOD AND DEVICE FOR PRODUCING A COATED PAPER WEB USING A COATED ROLL

[75] Inventors: Rüdiger Kurtz; Martin Kustermann; Michael Trefz, all of Heidenheim, Germany

[73] Assignee: Voith Sulzer Papiermaschinen GmbH, Heidenheim, Germany

[21] Appl. No.: 621,114

[22] Filed: Mar. 22, 1996

[30] Foreign Application Priority Data

Mar. 25, 1995 [DE] Germany ..... 195 11 050.1

[51] Int. Cl.[6] ..... B05D 1/28; B05C 1/08

[52] U.S. Cl. ..... 427/428; 118/249; 118/261; 118/262

[58] Field of Search ..... 427/428; 118/249, 118/261, 262

[56] References Cited

U.S. PATENT DOCUMENTS

| | | | |
|---|---|---|---|
| 4,664,058 | 5/1987 | Schroeder et al. | 118/249 |
| 5,203,920 | 4/1993 | Plomer | 118/249 |
| 5,246,497 | 9/1993 | Rantanen | 118/249 |

FOREIGN PATENT DOCUMENTS

| | | |
|---|---|---|
| 0 385 640 A2 | 9/1990 | European Pat. Off. . |
| 42 24 716 C2 | 2/1994 | Germany . |

*Primary Examiner*—Katherine A. Bareford
*Attorney, Agent, or Firm*—Taylor & Associates, P.C.

[57] ABSTRACT

The invention is directed to a method and device for the production of a paper web featuring a CF coating. The paper web passes through a nip (a) formed by a coating roll (2) and a backing roll (1). CF coating is applied on coating roll (2), dosed there by means of a dosing device (11) and transferred to paper web (3) in the nip, with the two rolls (1, 2) being compressed at a line force of maximally 10 kN/m.

9 Claims, 2 Drawing Sheets

METHOD AND DEVICE FOR PRODUCING A COATED PAPER WEB USING A COATED ROLL

BACKGROUND OF THE INVENTION

1. Field of the Invention

The present invention relates to a method and device for producing a paper web having a CF coating thereon.

2. Description of the Related Art

As is known, a CF coating (applied on paper) contains a color-reactive pigment which with a so-called CB coating of another paper (e.g., in a forms set) interacts in such a way that visible characters are created by the effect of pressure (for example, carbon-copying).

DE 4,224,716 C2 and DE 4,224,719 C2 each disclose a method using different ways for adjustment of two rolls, which form a nip through which a paper web is passed for coating. In one method, the nip is adjusted to a clearance "not smaller than the thickness of the uncoated paper." Expectations with this method are that it is very difficult, or even impossible, to transfer the coating mixture with the necessary uniformity to the paper web surface. It is very difficult to adjust the nip across the entire web width (which may amount to many meters, maximally about 10 m) exactly evenly. The clearance between the two roll shells may differ, for example, due to different temperatures and local diameter changes caused thereby.

Another method provides for adjusting between the two rolls a line force of 10–40 kN/m. This procedure risks pressing the applied CF coating excessively into the paper (in the spaces between the fibers). In other words, the penetration of the coating mixture in the paper is too high. Consequently, a greater, and thus relatively expensive color application is required to safeguard, later in the use of the coated paper, the desired "copying intensity." The uniformity of the CF coating is not optimum, e.g., an orange peel surface is sometimes created which impairs the applicational benefits. The printability of the paper side featuring the CF coating is thus reduced.

SUMMARY OF THE INVENTION

The present invention provides a finished, CF coated paper web which meets higher quality demands than heretofore possible.

Advantages of the present invention include: It was recognized by the present inventors that optimum results in view of the quality of the CF coating can be achieved exactly in the line force range between zero and 10 kN/m. Notably, the application of the relatively low line force safeguards that the pigment share of the CF coating mixtures form an even and continuous layer, without requiring to feed an excessively high amount of CF coating color. This contributes appreciably to manufacturing cost reductions. Moreover, it was recognized that, owing to the relatively low line force, also the liquid binder share of the CF coating color penetrates less in the paper, leaving a greater share of the binder in the CF coating. Resulting thereof, when printing on the CF coating of the finished paper, is the unexpected advantage that previous undesirable side effects, such as dust formation or sticking of the printing agent, are avoided extensively.

Especially favorable embodiments of the invention consist in providing for a specific nip length; that is, the paper web contacts in the nip both roll shells simultaneously over a certain stretch. The specific surface load can be kept at particularly low values here. This is true particularly also when one of the two rolls is fashioned as a shoe press roll, since in this case the load as is generally known is distributed over an especially large area. Similar to the known shoe press rolls (of papermaking machines), an especially sensitive and gradual increase of the load can be provided for as the paper web and the applied CF coating enter the nip. Possible at the same time is providing for a relatively swift, steep pressure drop at the exit from the nip. The uniformity (i.e., the "smoothness") of the surface of the CF coating is increased further thereby. The orange-peel effect which is a problem with known apparatus is thereby essentially avoided.

Adjusting the very low line force between zero and 10 kN/m, which is possible with the present invention, is achievable with conventional loading systems only with difficulty or not at all. It is possible, however, with the present invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
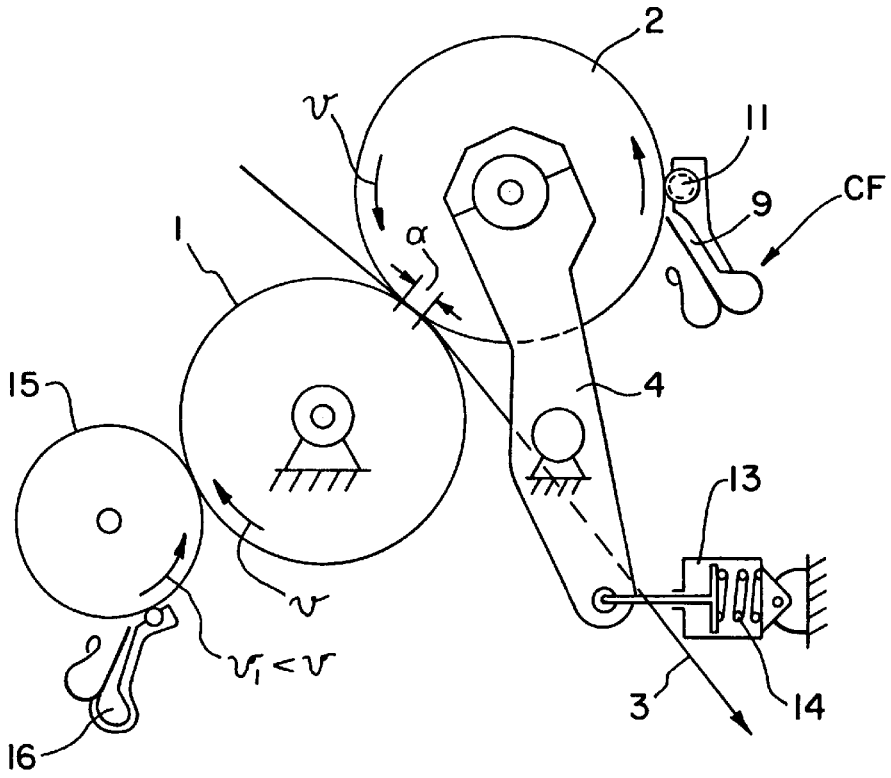
FIGS. 1, 2, 3 and 4 are schematic, side elevational views of different embodiments of a device of the present invention for producing a CF coated paper web.

FIG. 1 discloses an embodiment of a device for carrying out the method of the present invention, including a coating roll 2 and a backing roll 1 which form jointly therebetween a nip through which passes a paper web 3 being coated. Arranged in the free area of the shell surface of the coating roll 2 is a feed and dosing device for CF coating color, referenced CF overall. The CF device includes in known fashion a nozzle type feed duct 9 and, as a dosing element, a roll doctor 11 which preferably is provided with peripheral grooves. The CF device generates a thin film of the supplied CF coating color on coating roll 2 which then is transferred to the paper web in the nip.

As schematically indicated, one of the two rolls 2, 3 and preferably backing roll 1, rests in stationary bearings. In contrast, the bearings of the other roll, i.e., preferably the coating roll 2, are movable; that is, they rest, e.g., in pivot levers 4 actuated by means of a loading device (for instance, hydraulic cylinder 13). Hydraulic cylinder 13 causes a mutual loading of rolls 1 and 2, which is opposed by an energy store, for instance a compression spring 14. This allows adjusting the load acting in the nip very sensitively to extremely low values.

The diameters of the two rolls 1 and 2 and the materials, modulus of elasticity and hardness of the roll shells or roll covers as well as the level of line force acting in the nip is so chosen that measured in the running direction the length "a" of the nip amounts to at least 5 mm, preferably between 10 and 20 mm.

The other side of paper web 3 (according to FIG. 1, the underside) may remain unchanged as the CF coating is applied on the top side. As an alternative , as indicated schematically in FIG. 1, any medium, for example water or starch or any coating color (e.g., a CB coating color), can be applied by means of an additional applicator roll 15 interacting with an additional feed and dosing system 16, on the backing roll which transfers this medium then to the underside of the paper web 3. As indicated in FIG. 1, the peripheral speed $v_1$ of the additional coating roll is lower than the operating velocity v of the overall device. Accomplished thereby is an especially fine dosing of the applied medium.

Figure 2:
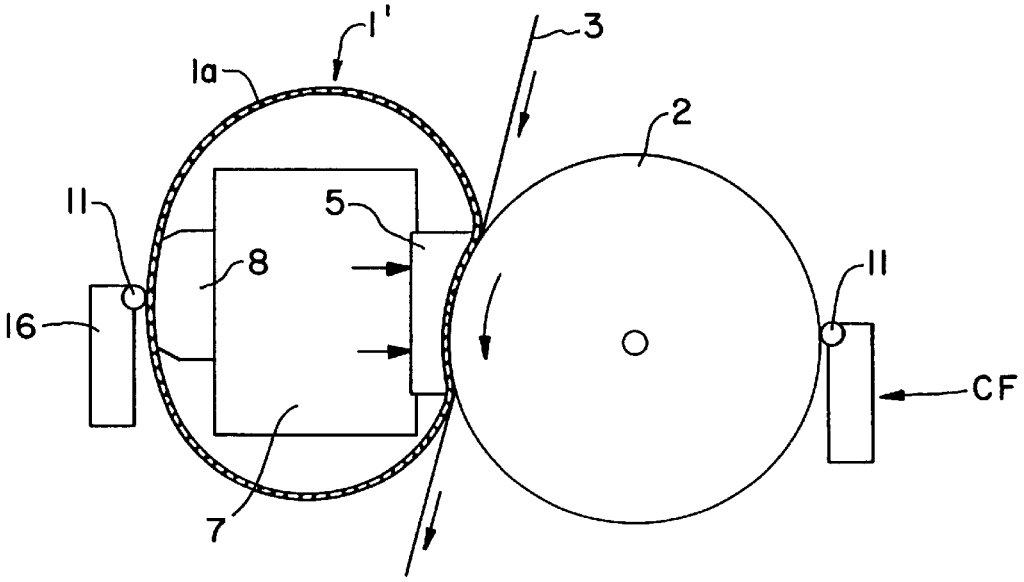

The exemplary embodiment relative to FIG. 2 differs from FIG. 1 essentially only in that a shoe press roll 1' is provided, instead of a regular backing roll. Shoe press roll 1' has a revolving flexible press shell 1*a* through which extends a stationary support 7. Movable radially, a press shoe 5 has for the press shell 1*a* a concave sliding surface (adapted to the coating roll 2). Press shoe 5 is fitted in the support 7 and can push the press shell 1*a* sensitively onto the coating roll 2. Opposite the movable press shoe 5, a stationary sliding shoe 8 with a convex sliding surface is provided on the support 7. Here, an additional feed and dosing device 16 can be fitted on the outside of press shell 1*a*, for application of any medium, via press shell 1*a*, on the other paper side.

Figure 3:
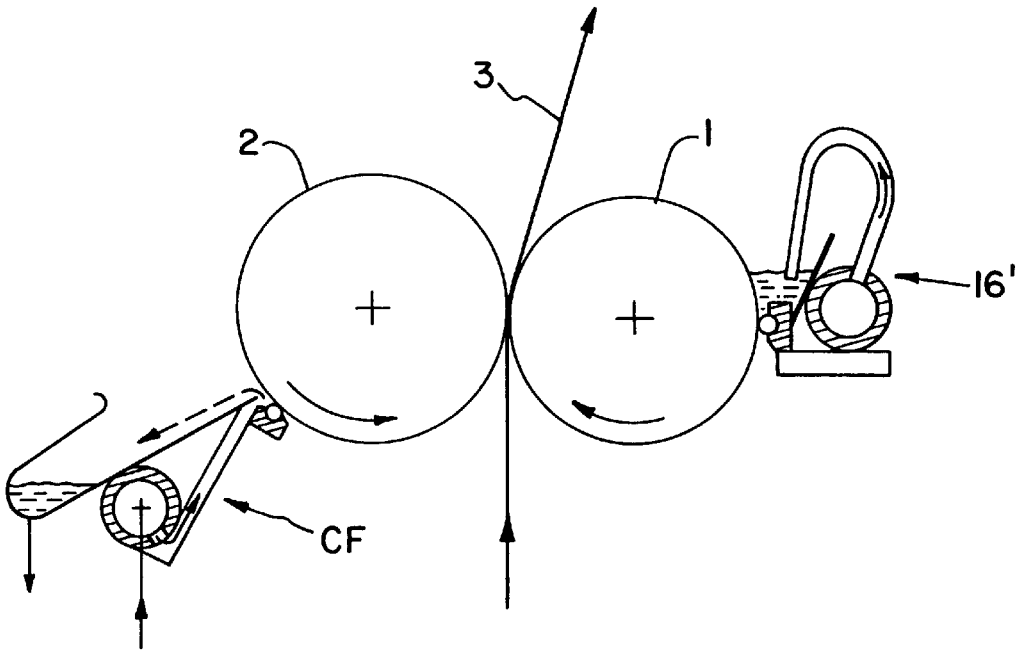
Figure 4:
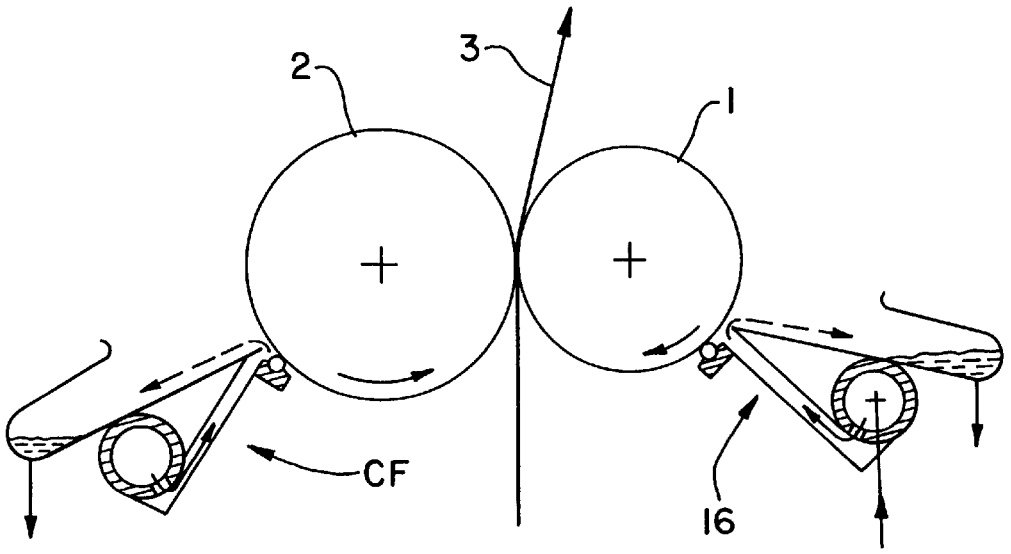

According to FIGS. 1 and 2, the paper web passes essentially from top to bottom through the nip. However, the opposite is possible as well, as can be seen from FIG. 3 and 4. Here, feed and dosing devices CF, or 16 or 16', are employed. Their design is such that they allow arrangement on the side of the respective roll shell running down. The feed and dosing device 16' provided on the backing roll relative to FIG. 3 forms together with the roll shell a liquid sump, while the other feed and dosing devices CF, or 16, avoid such sump and, therefore, are suited for higher operating speeds.

In variation from FIGS. 1–4, the following could be provided for: The CF coating color (and/or, as the case may be, the medium applied on the opposite side) can be fed to the respective roll 2, or 1, by means of an open-jet nozzle known as such. Thereafter, if required, surplus CF coating color (or surplus medium) may be scraped off the roll.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of producing a paper web having a coating on one side thereof, the coating including one of a mineral and organic color-reactive pigment, comprising the steps of:

passing the paper web through a nip formed by a coating roll and a backing roll;

applying the coating continuously on a revolving roll shell of said coating roll, and dosing said applied coating on said roll shell of said coating roll using a dosing device;

transferring said coating to said nip using said roll shell of said coating roll;

compressing said coating roll and said backup roll at a line force of maximally 10 kN/m at said nip; and applying the coating to the paper web in said nip.

2. The method according to claim 1, wherein said nip has a nip length, measured in a direction of travel of the paper web, which is at least 5 mm.

3. A device for producing a paper web having a coating on one side thereof, the coating including one of a mineral and organic color-reactive pigment, comprising:

a coating roll and a backing roll defining a nip therebetween, said coating roll having a roll shell;

a feed and dosing device for applying the coating on the roll shell of said coating roll; and a loading device for mutually compressing said coating roll together with said backing roll along a line force at said nip, said loading device being configured for sensitive adjustment of said line force up to a maximum of approximately 10 kN/m.

4. The device according to claim 3, wherein said nip has a nip length, measured in a direction of travel of the paper web, which is at least 5 mm.

5. The device according to claim 3, wherein the loading device includes a variable force generator, and an energy store for counteracting said variable force generator.

6. The device according to claim 5, wherein said energy store comprises one of a spring and backing cylinder.

7. The device according to claim 5, wherein said nip has a nip length, measured in a direction of travel of the paper web, which is at least 5 mm.

8. The device according to claim 7, wherein said backing roll has a roll shell, and wherein each of said roll shell of said coating roll and said roll shell of said backing roll include at least one of a hardness, modulus of elasticity, and diameter which effect said nip length.

9. The device according to claim 3, wherein one of said coating roll and said backing roll includes an elastically deformable press shell sliding over a press shoe.

* * * * *

UNITED STATES PATENT AND TRADEMARK OFFICE

CERTIFICATE OF CORRECTION

PATENT NO. : 5,811,157

DATED : September 22, 1998

INVENTOR(S) : Kurtz, et al.

It is certified that error appears in the above-identified patent and that said Letters Patent is hereby corrected as shown below:

Column 2

Line 52, delete "2, 3" and substitute -- 1, 2 -- therefor.

Signed and Sealed this

Eleventh Day of May, 1999

*Attest:*

Q. TODD DICKINSON

*Attesting Officer*

*Acting Commissioner of Patents and Trademarks*